US005775628A

United States Patent [19]

Rabe et al.

[11] Patent Number: 5,775,628

[45] Date of Patent: Jul. 7, 1998

[54] DISCONTINUOUSLY OPERATING WINDING MACHINE FOR WINDING ON MATERIAL TO BE WOUND

[75] Inventors: Helmut Rabe, Wehretal; Ernst Döring, Wilbich, both of Germany

[73] Assignee: Georg Sahm GmbH & Co. KG, Eschwege, Germany

[21] Appl. No.: 730,693

[22] Filed: Oct. 11, 1996

[30] Foreign Application Priority Data

Oct. 13, 1995 [DE] Germany ..... 195 38 095.9

[51] Int. Cl.[6] ..... B65H 35/04

[52] U.S. Cl. ..... 242/527.3; 242/533.4

[58] Field of Search ..... 242/526, 527.3, 242/533.4, 533.5, 533.6

[56] References Cited

U.S. PATENT DOCUMENTS

| | | | |
|---|---|---|---|
| 2,586,833 | 2/1952 | Kohler et al. | 242/527.3 |
| 3,486,708 | 12/1969 | Lamon | 242/533.6 X |
| 3,871,595 | 3/1975 | Smolderen | 242/533.4 X |
| 4,431,140 | 2/1984 | Tetro | 242/527.3 X |
| 4,458,852 | 7/1984 | Calvert et al. | 242/527.3 X |
| 4,798,350 | 1/1989 | Jorgenson et al. | 242/533.4 X |
| 5,484,499 | 1/1996 | Marschke | 242/526 X |

FOREIGN PATENT DOCUMENTS

| | | | |
|---|---|---|---|
| 5147824 | 6/1993 | Japan | 242/533.4 |

*Primary Examiner*—Donald P. Walsh
*Assistant Examiner*—William A. Rivera
*Attorney, Agent, or Firm*—Thomas, Kayden, Horstemeyer & Risley

[57] ABSTRACT

A material winding and cutting machine is capable of automatically winding and cutting specified lengths of a material formed on a removable workpiece. Winding spindles (10 and 11) are rotatably mounted to drum (4) and revolve with the rotation of the drum between a winding station and a doffing station. Tubes (20) and fixed to the spindles (10 and 11) to receive the material (13). The machine includes a brake (27) which stops rotation of the material (13) about a winding spindle (10) during the cutting operation. The brake assembly stops the winding spindle to provide for an accurate cutting of the material to a predetermined length. Since the material does not rotate about the winding spindle during the cutting operation, the winding spindle incorporates a force storage device (28) to provide the needed tension to the material for proper cutting.

8 Claims, 4 Drawing Sheets

DISCONTINUOUSLY OPERATING WINDING MACHINE FOR WINDING ON MATERIAL TO BE WOUND

FIELD OF THE INVENTION

The invention concerns a discontinuously operating winding machine for winding on material to be wound, in particular adhesive strip, comprising a drivable winding spindle and a laying device arranged upstream thereof. The term discontinuously operating winding machine is used to denote a winding machine in which the material to be wound on, which is fed to the winding machine, is stopped or, for the period of the bobbin change operation, is accommodated in a storage means which is disposed upstream of the winding machine. That means that immediately upstream of the winding machine, the material to be wound is fed to the winding machine in one operating phase thereof whereas it is stationary in another operating phase. It will be appreciated that this other operating phase is used to effect the bobbin change operation. The winding machine serves for winding on material to be wound, in particular adhesive strips, tear-open strips and the like, in which respect it is generally important accurately and reproducibly to keep to the running length which is to be wound on to a bobbin.

BACKGROUND OF THE INVENTION

A discontinuously operating winding machine of the kind set forth in the opening part of this specification, for the stated purpose of use, is known. It has a drivable winding spindle which is driven in the one operating phase and which is stationary in the other operating phase. An empty tube is fitted manually on to the winding spindle in known manner and clamped fast thereon. The material to be wound is manually attached to the tube and the operating phase of winding on the material is begun. That winding operation, depending on the running length involved, may take for example a period of time of half an hour. In general a plurality of winding machines are combined together to form a winding installation so that the winding operation is effected simultaneously at all winding machines. When the individual bobbin on a winding machine and therewith the bobbins on all winding machines are fully wound with material, the installation and therewith the individual winding machines on the one hand as well as the delivery of material to the machines are stopped. Beginning at the first winding machine, the winding material is severed, for example being manually cut through by means of a shearing tool, the full bobbin is removed, an empty winding tube is fitted on to the spindle and the new leading end of a piece of material to be wound is connected to the empty tube. That manual activity is now effected successively at all winding machines of the installation until empty tubes have been fitted on to all the winding machines and the respective leading ends of the lengths of material to be wound on are attached to the respective tubes. Depending on the number of winding machines in the installation, that operation also requires for example approximately half an hour. The entire installation is stopped during that period. The running time of the winding machine or the installation is 50%.

SUMMARY OF THE INVENTION

The invention is based on the above-outlined problem and aims to provide a winding machine for the described situation of use, which permits manual severing of the material to be wound in the bobbin change operation and permits the material to be joined by machine to an empty tube, in order to increase the running time.

In accordance with the invention that is achieved in that there are provided two alternately drivable winding spindles which are freely rotatably mounted on a pivotable drum and which are pivotable alternately as a working spindle into a winding position and as a reserve spindle into a change position, that there is provided a cutting device for severing the material to be wound, in the stopped condition, and that the winding machine has a device for tightening the material to be wound, when cutting it and attaching it.

The invention is first of all based on the idea of providing two alternately drivable winding spindles and mounting them freely rotatably on a pivotable drum, as is known per se in relation to continuously operating winding machines in which the continuous feed of material to be wound cannot be interrupted. That affords the possibility of pivoting a respective one of the winding spindles as the working spindle into the winding position and stopping the drum. The winding-on operation can then be effected using that winding spindle. After the bobbin is fully wound, the drum is rotated, more specifically through 180° so that now the other winding spindle is in the winding position while conversely the previously wound working spindle is now in the change position in which the full bobbin can be removed and a fresh empty winding tube can be fitted thereon. Admittedly that occurs during the time during which a new winding operation takes place on the working spindle which is in the winding position. That increases the operational running time of the winding machine. When the one winding spindle with a fully wound bobbin pivots into the change position, while at the same time a winding spindle with an empty tube pivots into the winding position, both winding spindles are stationary and the material to be wound extends from the periphery of the full bobbin over the periphery of the empty tube towards the laying device and beyond same to a delivery device. The machine has a cutting device for severing the material to be wound, in the stopped condition, with the portion of material between the periphery of the full bobbin and the periphery of the empty tube being severed. Since, in the stopped condition of the winding spindle in the change position, that winding spindle is freely rotatable, it is necessary to ensure that the portion of the material between the full bobbin and the empty tube of the other winding spindle is prevented from forming a loop, with that portion sagging downwardly. For that purpose the winding machine has a device for tightening the material to be wound. That tightening device has a multiple function to perform. On the one hand, by virtue of its tightening effect, it always holds the respective portion of material reproducibly at the same location on a path of movement so that the cutting device can be positioned there in such a way that it is movable through the material which is held in a taut condition. By virtue of the material being held in a taut condition, the cutting device can reliably perform its function. At the same time however the operation of attaching the material to the empty tube is effected by the operation of tightening the material. If for example the material which is to be wound on is an adhesive strip of which one surface that is towards the empty tube is adhesive in nature, then the tightening operation provides that the material comes into sufficiently firm contact with the empty tube so that, after the operation of cutting the material, the new leading end which is formed in that way already adheres to the periphery of the empty tube and the new winding procedure can begin. In the event that the material which is to be wound on is a non-adhesive material, the empty tube for example is to be of a suitably adhesive nature, or the like.

It is important to realise that both winding spindles are stopped, that is to say neither of the winding spindles is driven, in the operation for cutting the material and attaching it to a bobbin. During that common stoppage time the material is held in a tautened condition and at the same time cut off and attached to the bobbin. All those procedures take place mechanically so that, during the subsequent winding procedure, sufficient time is available for a full bobbin in the change position to be removed from the winding spindle and an empty tube to be fitted on to the spindle and clamped fast thereon, manually at each winding machine of the installation. The operational running time of the installation is therefore approximately doubled in comparison with the state of the art. The winding spindle is stopped in the winding position when the desired running length has been wound on to same. For that purpose the machine has a suitable measuring device for measuring the running length and a suitable control device for control of the rotational drive of the winding spindle in the winding position.

The device for tightening the material to be wound, when cutting same and attaching it to a bobbin, may have a brake for temporarily preventing free rotary movement of the winding spindle which pivots into the change position, and a force storage means for tightening the material to be wound, during the operation of severing the material and during the operation of attaching the material to a bobbin. The brake ensures that the winding spindle which pivots into the change position does not rotate freely and uncontrolledly during that pivoting procedure so as to prevent the material from hanging down and sagging. The force storage means which acts on the winding spindle is caused to act on the winding spindle at the end of the pivoting operation so as to cause the material to be tightened. That involves in particular the portion of material which extends from the periphery of the full bobbin to the periphery of the empty tube on the other winding spindle. By virtue of the force storage means being triggered into operation by release of the brake, the material is pulled tight with the force produced by the force storage means and the material is pressed against the empty tube so that the material is fitted thereto by machine.

The force storage means can be in the form of a spring storage means which can be loaded up and which is therefore loaded up again in each revolution of the drum. It will be appreciated that the drum only rotates in each case through 180° and in that respect each winding spindle is provided with a spring storage means which can be loaded up.

A respective rotary ring can be freely rotatably mounted on each winding spindle, wherein the spring storage means has a torsion spring which surrounds the winding spindle and of which one end is connected to the winding spindle and the other end is connected to the rotary ring. The spring storage means can be loaded up by way of a tensioning device by rotation of the rotary ring. During that loading procedure the brake comes into operative effect, that is to say it brakes the winding spindle, so that the support means for the torsion spring, which support means is associated with the winding spindle, is held relatively firmly. The force of the brake and of the force storage means are desirably matched to each other, more specifically in such a way that a certain tightening effect is already exerted on the material to be wound, during the pivoting procedure. That ensures that the material to be wound is always held taut and for example a small strip portion cannot become twisted.

The tensioning device for the spring storage means for tensioning same by rotation of the rotary ring may have a stationarily arranged segment whose edge is in contact with the rotary ring during the pivotal movement of the winding spindle into the change position over a fixed angular region, the angular region also extending to the change position. That segment is arranged stationarily, more specifically in such a region that it comes into contact with the rotary ring over a fixed angular region and in that respect the pivotal movement of the drum is converted into a rotary movement of the rotary ring and thus into loading of the spring storage means, and thus the pivotal movement of the drum is utilised. The force of the spring storage means is increased with the rotary movement of the rotary ring relative to the winding spindle which is held fast by the brake, and an increasing tightening effect is produced, although the brake can certainly slip.

A control device may be associated with the brake, the control device maintaining the braking action on the winding spindle over the angular region defined by the segment with the exception of an end region in the change position. The brake is in an operative condition so that the spring storage means can be loaded up over a substantial initial part of the angular region which is defined by the extent of the segment. In contrast the brake is released when the respective winding spindle reaches the end point or end region in the change position, so that the spring storage means can produced its effect on the winding spindle to provide for a rotary movement thereof. It will be appreciated that the direction of rotation is so selected that a force in the tightening direction is applied to the material to be wound, by way of the winding spindle.

The rotary ring and/or the edge of the segment may be provided with a friction-increasing layer, in particular a lining. Such a layer may also comprise a rolling ring which is fitted on to the rotary ring. It ensures that, by contact of the rotary ring against the segment, the pivotal movement of the drum is converted into a rotational movement for the rotary ring, by which in turn the spring storage means is loaded.

A brake disc may be arranged at each winding spindle. A respective brake pad or block is arranged on the drum for each winding spindle, and a stationarily arranged actuating cam ring is associated with the brake pads, the cam ring ensuring that, in the appropriate angular regions of the drum, the brake is so actuated or released at each winding spindle, as is required over the rotational movement of the drum. Springs with adjustable spring support means may be associated with the brake pads, in order to be able to provide for fine setting of the braking force applied by the brake.

Each winding spindle may carry one half of a coupling means while the other half of the coupling means is connected to a motor arranged in the winding position. In that way the winding machine only requires a single motor. It is naturally also possible to provide a separate motor for each winding spindle and for the motors to be fitted on to the drum or for the motors to apply the rotational drive to the winding spindles by way of an intermediate transmission. In that situation the respective motor may also perform the function of a brake.

The cutting device for severing the material in the stopped condition can be mounted in the hollow shaft of the drum and may be displaceable parallel to the axes of the winding spindles. That reliably provides for the severing operation to be effected.

The invention is described and illustrated in greater detail by means of a preferred embodiment. In the drawing:

DETAILED DESCRIPTION

Figure 1:
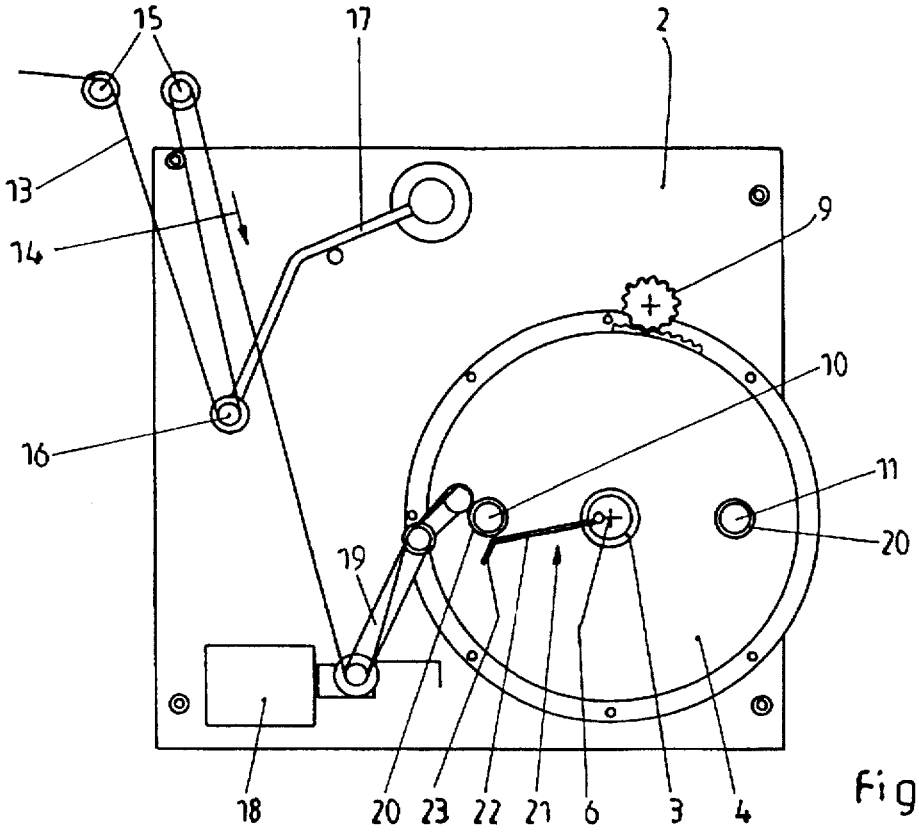
FIG. 1 is a diagrammatic front view of the overall structure of the winding machine.
Figure 2:
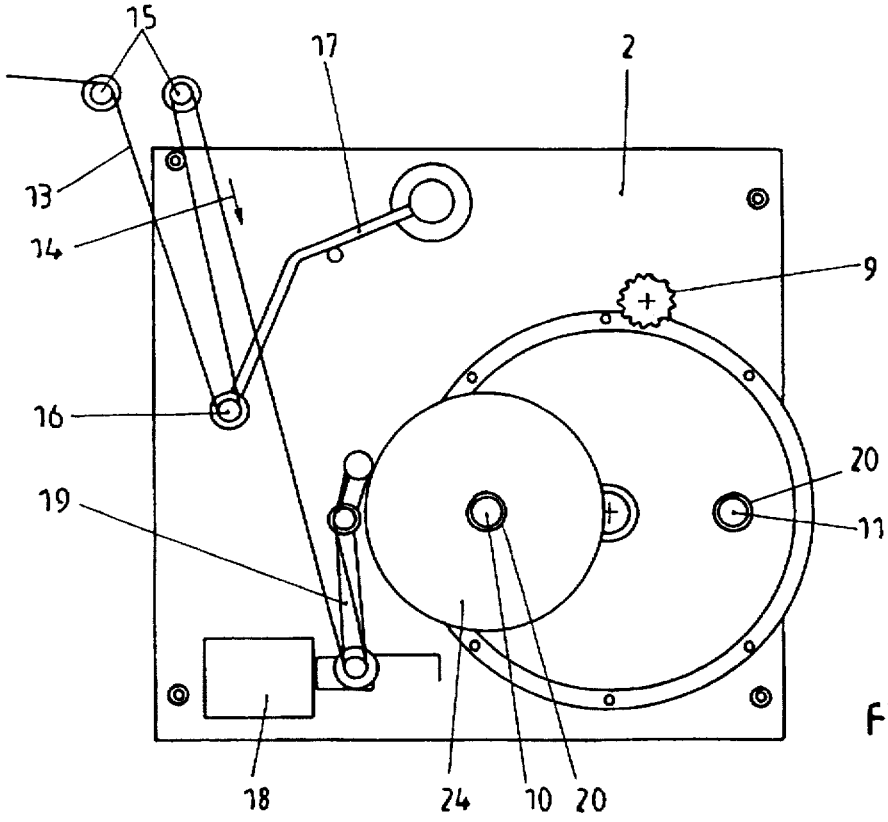
FIG. 2 shows the winding machine illustrated in FIG. 1 at the end of the winding phase.
Figure 3:
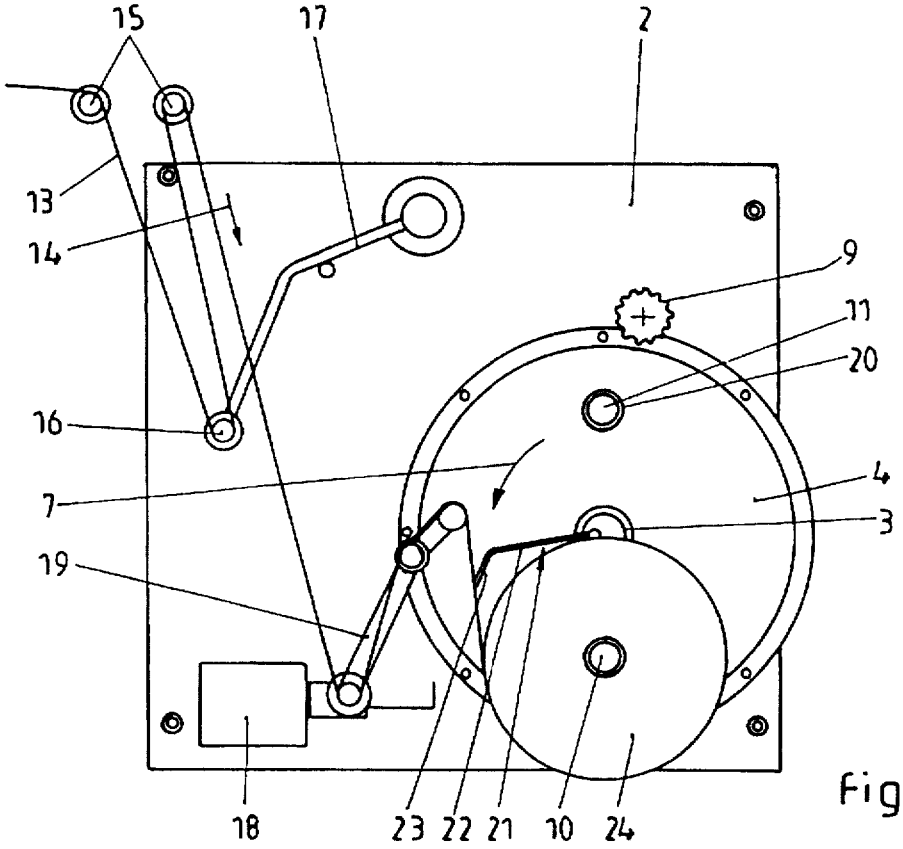
FIG. 3 shows an intermediate position of the winding machine.

Referring to FIGS. 1 to 4, shown therein are front views illustrating a series of illustrations of the winding machine in order clearly to show the mode of operation of the arrangement. Fixedly connected to a frame 1 (FIG. 5) is a housing plate 2 which serves to carry and mount essential elements of the arrangement. Reference 3 denotes a hollow shaft which is stationarily arranged in the housing plate 2 and on which a drum 4 is rotatably or pivotably mounted. Ball bearings 5 (FIG. 5) are provided for that freely rotatable mounting action. The drum 4 is thus pivotable about the central axis 6, more specifically in the direction of the arrow 7 (FIG. 3). The drum 4 is provided with a ring gear 8 co-operating with a pinion 9 (FIG. 1) so that the drum can be pivoted by way of a motor (not shown here).

Two winding spindles 10 and 11 are freely rotatably mounted on the drum 4. The winding spindle 10 is in the winding station and can thus be referred to as the working spindle. The winding spindle 11 is in the change or doffing position and can thus be referred to as the reserve spindle. When the drum 4 pivots through 180° in the direction of the arrow 7, the described functions correspondingly change. Each winding spindle 10, 11 is freely rotatably mounted on the drum 4 by way of ball bearings 12. Material 13 to be wound is fed to the winding machine as indicated by the arrow 14. The material 13 passes over stationary rollers 15 and a roller 16 to a compensating dancer arm 17 which serves for yarn tension regulation in known manner. The material 13 passes by way of a laying device 18, for example a traversing device, and by way of a roller yarn guide 19, on to the empty tube 20 on the winding spindle 10. The leading end of the material 13 is attached to the empty tube 20. That can be effected by virtue of the fact that the material 13 is an adhesive strip whose adhesive-coated side, facing towards the empty tube 20, is secured thereto by adhesive. If the material 13 is a non-adhesive material, the empty tube 20 is suitably designed for the material 13 to be fitted thereto.

A cutting device 21 is provided in the centre of the drum 4, that is to say in the hollow shaft 3. Arranged on an axis which passes through the hollow shaft 3 is a cutting arm 22 having a blade 23 which is displaceable parallel to the central axis 6 and thus parallel to the winding spindles 10 and 11 respectively.

Figure 4:
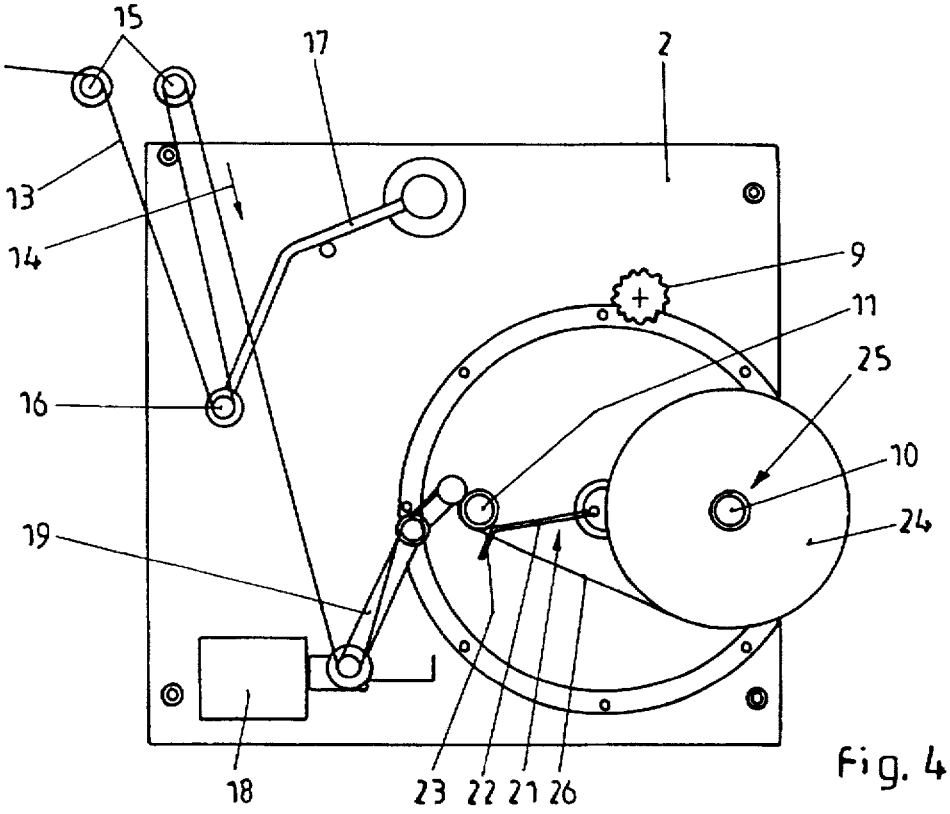
FIG. 4 shows the winding machine of FIG. 1 during the cutting operation.

At the beginning of a winding operation, the winding spindle 10 in the working position shown in FIG. 1 and with material 13 attached thereto is caused to rotate so that a bobbin 24 (FIG. 2) is built up on the tube 20. When the prescribed running length of material 13 on the empty tube 20 is reached, the winding spindle 10 is stopped again. Before that, an empty tube 20 is fitted on to the winding spindle 11 and clamped fast thereon. The winding spindle 11 is also in the stopped condition. As a comparison of FIGS. 2 to 4 shows, the drum 4 with the two stationary winding spindles 10 and 11 is now pivoted through a total of 180° as indicated by the arrow 7, in which case the winding spindle 10 with the full bobbin 24 now moves into the change or doffing position while the winding spindle 11, as the new working spindle, moves into the winding position. In that case, the empty tube 20 which is already on the winding spindle 11 already comes into contact with the adhesive side of the material 13. The winding machine or each winding spindle 10, 11 is provided with a device 25 for tightening the material 13, in the operation of cutting it and attaching it to the respective tube, and the construction and the mode of operation of the tightening device 25 will be described in greater detail with reference to FIGS. 5 and 6. The tightening device 25 applies a tightening effect to the portion 26 of the material 13, which extends from the periphery of the full bobbin 24 to the empty tube 20 of the winding spindle 11, in a direction towards the roller yarn guide 19. Now, as shown in FIG. 4, the cutting device 21 (in the stopped condition of the winding spindles 10 and 11) is actuated so that the blade 23 passes through the portion 26 of the material 13, which is held taut, and thus severs the material portion 26. The winding spindle 11 which is now in the winding position is then caused to rotate and a fresh winding phase takes place. That all occurs automatically or by machine. It is only the bobbin change operation which is performed by hand, in the position shown in FIG. 4. The full bobbon 24 including the tube 20 is released from the winding spindle 10 and a fresh empty tube 20 is fitted on to the winding spindle 10. That operation is effected at all winding machines of the installation, more specifically while the respective winding spindle 11 is winding material 13 on to a further bobbin.

Figure 5:
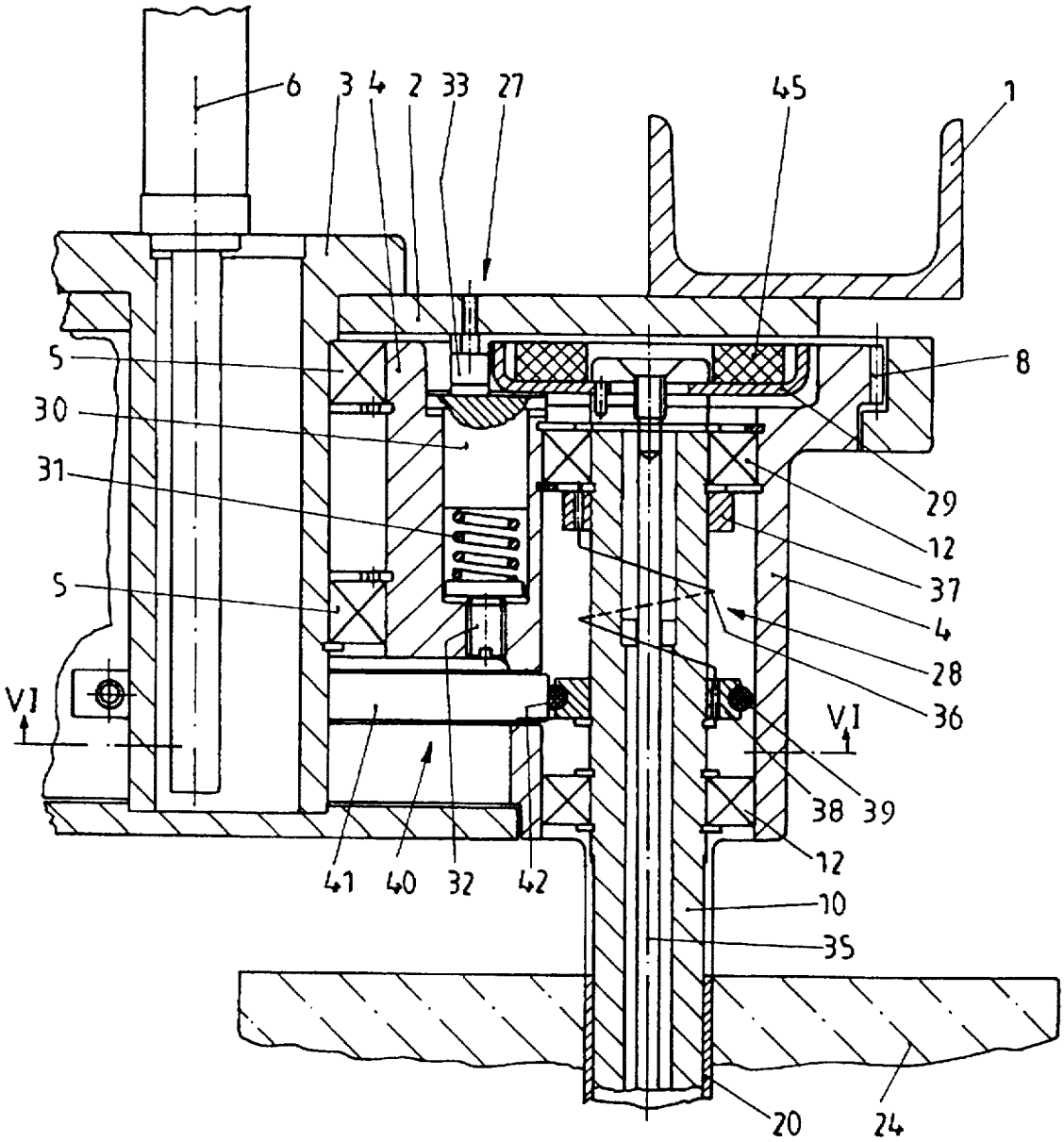
FIG. 5 is a section through the winding spindle in the change position.
Figure 6:
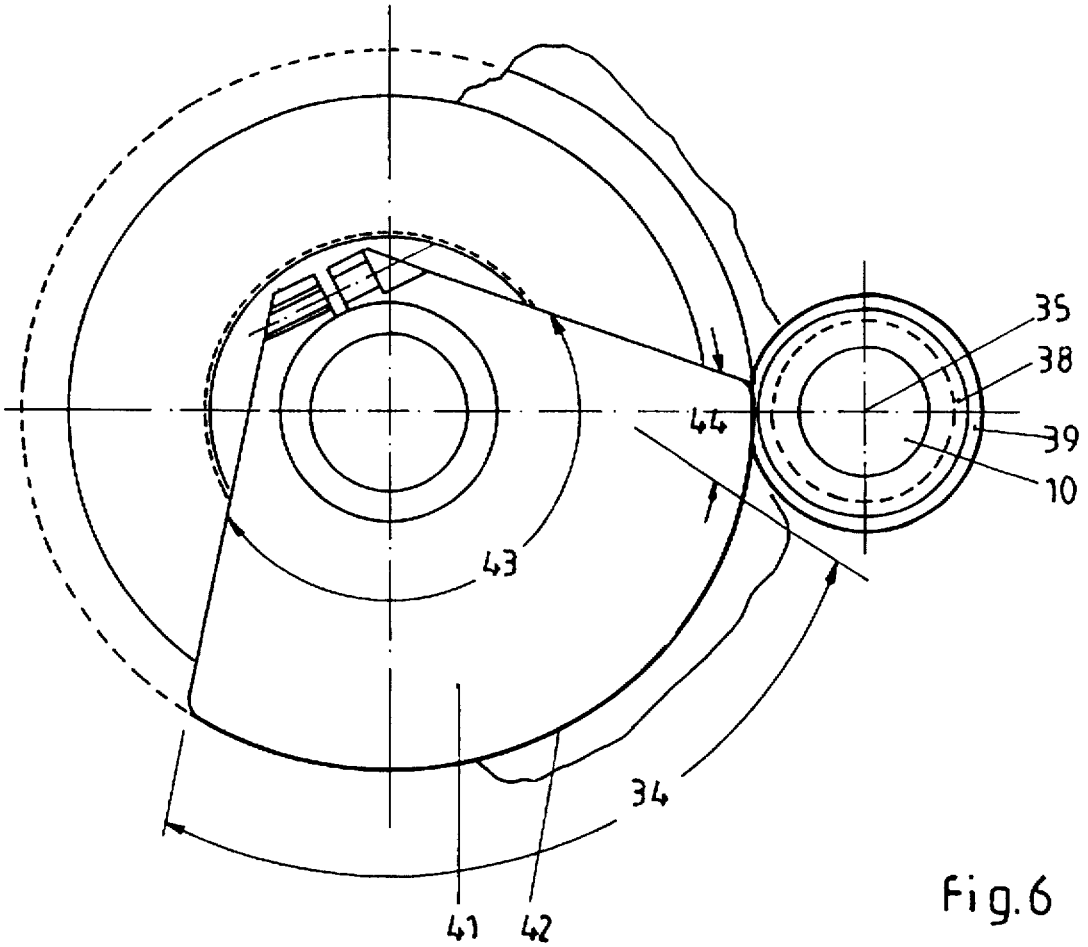
FIG. 6 is a view in section taken along line V—V in FIG. 5.

The device 25 for tightening the material 13 in the procedure of cutting same and attaching same to a tube 20 is described with reference to FIGS. 5 and 6. Essential components of the device 25 are a brake 27 and a force storage means 28. The brake 27 has a brake disc 29 which is fitted on to the winding spindle 10 at the end thereof remote from the bobbin 24, and is non-rotatably connected to the winding spindle 10. Co-operating with the brake disc 29 is a brake block or pad 30 which is arranged in the housing of the drum 4 and which thus rotates with the drum 4 and which acts against the brake disc 29. A spring 31 whose force can be sensitively set by way of an adjusting screw 32 urges the brake pad 30 towards the brake disc 29. Stationarily mounted on the housing plate 2 is an actuating cam ring 33 which is arranged to project over the periphery of the housing plate 2 and which has regions or projections which project to different heights in the axial direction, as is required for operation of the brake 27. FIG. 5 shows the released condition of the brake 27, in the change position. The brake pad 30 is lifted off the brake disc 29, at a clearance relative thereto. It will be appreciated that the cam actuating ring 33 also disengages the brake 27 or holds it in a released condition, in the winding position. The actuating cam ring 33 is of such a configuration that in an angular region 34, it permits the brake pad 30 to bear against the brake disc 29 so that the brake 27 performs its braking function in that angular region 34. Free rotatability of the winding spindle 10 about its axis 35 on the drum 4 is prevented by the brake 27 over the angular region 34. It can be seen from FIG. 6 that the angular region 34 extends over an angle of perhaps 80°, but excludes the end position of the winding spindle 10. Free rotatability of the winding spindle 10 about its axis 35 is not impeded in the change position.

The force storage means 28 can be in the form of a spring storage means with a torsion spring 36. The torsion spring 36 extends around the winding spindle 10. One end of the torsion spring 36 is non-rotatably connected to the winding spindle 10, by way of a ring 37. The other end of the torsion spring 36 engages into a rotary ring 38 which is freely rotatably mounted on the winding spindle 10. The rotary ring 38 can be freely movably mounted on the winding spindle 10, by way of a ball bearing assembly (not shown). The periphery of the rotary ring 38 may be provided with a layer 39, for example in the form of a rolling ring. A tensioning device 40 serves to tension the force storage means 28. Besides the rotary ring 38, as an essential element, the tensioning device 40 comprises a fixed segment 41. The segment 41 has an edge 42 co-operating with the rotary ring 38. The segment 41 has an angular region 43 which is larger than the angular region 34 and is congruent therewith over wide portions thereof. The angular region 43 also includes in particular the change position. The segment 41 is arranged or clamped fast stationarily on the hollow shaft 3 so that, upon pivotal movement of a winding spindle 10, 11 into the change position, the rotary ring 38 rolls against the edge 42 and thus performs overall a rotary movement about the moving axis 35 of the winding spindle 10 or 11 respectively. With that rotary movement, the force storage means 28 is loaded up or the torsion spring 36 is tensioned. That is possible for the reason that the brake 27 brakes the brake disc 29 and therewith the winding spindle 10, 11 over the angular region 34. It will be appreciated that the brake 27 is sensitively matched to the force storage means 28, more specifically in such a way that the applied brake can slip slightly when loading the force storage means 28, while applying a tightening effect to the portion 26 of the material 13. It is therefore the portion 26 of the material 13 itself, which provides the counteracting force in relation to the loading force of the force storage means 28. That results in the desired tightening effect for the protion 26 of the material 13. That tightening effect serves not only to keep the portion 26 taut and stretched for the purposes of severing it by virtue of operation of the cutting device 21, but at the same time the tightening effect also causes the portion 26 of the material 13 to be pressed against the empty tube 20 of the winding spindle 10 in the winding station (FIG. 1). The operation of fitting the material 13 to the empty tube 20 is thus carried into effect by machine means. It can be seen from FIG. 6 that the angular region 43 is greater than the angular region 34 and also extends to the change position. The difference in the two regions defines an end region 44 which includes the change position and in which admittedly the rotary ring 38 of the tensioning device 40 is held fast and is thus prevented from rotating; in that situation, the brake 27 is released in the end region 44 so that the torsion spring 36 of the force storage means 28 is now capable of rotating the respective winding spindle 10 or 11 in the direction of rotation about the axis 35. That now provides for the final tightening effect on the portion 26 of material 13, as is required for the operation of severing the material 13 and attaching it to the new empty tube 20.

Although the device 25 for tightening the material 13 was described in connection with the spindle 10, it will be appreciated that the corresponding elements are also provided at the winding spindle 11. A corresponding description therefore applies in relation thereto. Only the actuating cam ring 33 is provided just once, and extends over the periphery of the drum 4.

The one half 45 of a permanent-magnet synchronous coupling means is non-rotatably connected to each winding spindle 10 or 11 respectively. The other half of the coupling means is disposed on the winding motor (not shown). It is sufficient to provide only one winding motor for this winding machine, the axis of the winding motor being aligned with the axis of the working station.

While the specification and drawings describe and illustrate a preferred embodiment of the invention, it will be understood by those skilled in the art that variations and modifications thereof can be made without departing from the spirit and scope of the invention, as defined in the accompanying claims.

List of references

1 Frame
2 Housing plate
3 Shaft
4 Drum
5 Ball bearing
6 Central axis
7 Arrow
8 Ring gear
9 Pinion
10 Winding spindle
11 Winding spindle
12 Ball bearing
13 Material to be wound
14 Arrow
15 Roller
16 Roller
17 Compensating dancer arm
18 Laying device
19 Roller yarn guide
20 Tube
21 Cutting device
22 Cutting arm
23 Blade
24 Bobbin
25 Device
26 Portion
27 Brake
28 Force storage means
29 Brake disc
30 Brake pad
31 Spring
32 Adjusting screw
33 Actuating cam ring
34 Angular region
35 Axis
36 Torsion spring
37 Ring
38 Rotary ring
39 Layer
40 Tensioning device
41 Segment
42 Edge
43 Angular region
44 End region
45 Half

We claim:

1. A discontinuously operating winding machine for winding material onto removable tubes comprising:

a frame;

a drum pivotally connected to said frame and rotatable about its longitudinal axis;

a plurality of spindles offset from said longitudinal axis and rotatably mounted on said drum for mounting and rotating tubes for winding with said material, each of said spindles having a longitudinal axis;

a means for rotating said drum about its longitudinal axis such that said spindles revolve from a winding position to a tube changing position;

a means connected to said frame for laying material on tubes mounted on said spindles when one of said spindles occupies said winding position;

a tightening device connected to each of said spindles including a brake assembly and a force storage means; said brake assembly arranged to temporarily prevent free rotary movement of said spindles while said spindles revolve from a winding position to a tube change position; said force storage means of each spindle arranged to collect and store energy imparted thereon as the spindles revolve from said winding position to said tube change position, and a cutting means connected to said frame for cutting the material extending toward a spindle as the spindle is temporarily prevented by said brake assembly from rotating freely about said longitudinal axis of said spindle.

2. A discontinuously operating winding machine for winding material onto removable tubes comprising:

a frame;

a drum pivotally connected to said frame and rotatable about its longitudinal axis;

a plurality of spindles offset from said longitudinal axis and rotatably mounted on said drum for mounting and rotating tubes for winding with said material, each of said spindles having a longitudinal axis;

a means for rotating said drum about its longitudinal axis such that said spindles revolve from a winding position to a tube changing position;

a means connected to said frame for laying material on tubes mounted on said spindles when one of said spindles occupies said winding position;

a tightening device connected to each of said spindles including a brake assembly, a torsion spring and a rotary ring;

said brake assembly arranged to temporarily prevent free rotary movement of said spindle while said spindle pivots from a winding position to a tube change position;

said rotary ring freely rotatably mounted to said spindle such that said rotary ring may freely rotate about said longitudinal axis of said spindle, and said torsion spring having a first end and a second end, said first end connected to said spindle, and said second end connected to said rotary ring, such that rotation of said rotary ring displaces said torsion spring causing said torsion spring to store torsional energy.

3. A discontinuously operating winding machine according to claim 2, wherein said tightening device is further defined as having a segment connected to said frame;

said segment having an edge and a first angular region, said edge operatively engaging said rotary ring while said spindle rotates through said first angular region of said segment, said first angular region defined by an arc extending from said winding position and terminating at said tube change position, such that said rotary ring rotates while said spindle rotates from said winding position to said tube change position.

4. A discontinuously operating winding machine according to claim 2, wherein said segment is further defined as having a second angular region defined by an arc extending co-extensively from said winding position with said first angular region and terminating prior to said tube change position, said second angular region operatively engaging said brake assembly, such that said brake assembly brakingly engages said spindle as said spindle rotates through said second angular region.

5. A discontinuously operating winding machine according to claim 4, wherein said rotary ring and said edge of said segment are further defined as having a means for increasing friction therebetween.

6. A discontinuously operating winding machine as in any one of claims 2–5, in which said brake assembly is further defined as having a brake disc, a brake pad and an actuating cam ring, said brake disc connected to said spindle, said brake pad mounted to said drum and said actuating cam ring mounted to said frame and operatively arranged with said brake pad.

7. A discontinuously operating winding machine according to claim 6, further comprising a coupling means having a first and second half and a motor, said first half attached to said spindle and said second half attached to said motor, said second half also arranged to operatively engage said first half while said spindle occupies said winding position.

8. A discontinuously operating winding machine according to claim 7, wherein said drum is further defined as having a hollow shaft, and said cutting means is further defined as a cutting device having a mounting portion, said mounting portion mounted within said hollow shaft and displaced parallel to said axes of said spindles.

* * * * *